US005393299A

United States Patent [19]

Brettin

[11] Patent Number: 5,393,299

[45] Date of Patent: Feb. 28, 1995

[54] EXTREMITY ATTACHED CONTAINMENT APPARATUS FOR LAVAGED FLUIDS

[76] Inventor: Larry W. Brettin, R.R. 1, Box 101 A, Riverton, Ill. 62561

[21] Appl. No.: 116,737

[22] Filed: Sep. 7, 1993

[51] Int. Cl.[6] ..... A47K 3/022

[52] U.S. Cl. ..... 601/166; 607/87; 4/621; 4/650

[58] Field of Search ..... 4/538, 541.1, 559, 584, 4/615, 621, 624, 650, 652, 901; 601/154, 156, 160, 166; 607/82, 86, 87; 134/200

[56] References Cited

U.S. PATENT DOCUMENTS 2,730,104 1/1956 Newman ..... 601/166 X
3,416,544 12/1968 Paiva ..... 134/220 X
4,192,297 3/1980 Labrecque ..... 601/166

*Primary Examiner*—Robert M. Fetsuga

[57] ABSTRACT

A new and improved containment apparatus for lavaged fluids includes a container assembly and a transparent lid assembly placed on top of the container assembly with a patient's appendage contained therebetween. The container assembly is adapted to support and partially encompass an appendage of a patient. A transparent lid assembly is adapted to be supported by the container assembly. The transparent lid assembly and the container assembly define a lavage chamber. The transparent lid assembly is adapted to partially encompass the patient's appendage. The container assembly and the transparent lid assembly include respective sealing assemblies for preventing fluids from leaking past the patient's appendage and the respective container assembly and transparent lid assembly. The transparent lid assembly includes a plurality of entry ports for permitting a hand-held lavage nozzle to pass through the transparent lid assembly into the lavage chamber. The entry ports include flap valves for sealing the entry ports when a lavage nozzle is not inserted therethrough. An inflatable sealing assembly may be provided for sealing the patient's appendage with respect to the container assembly and the transparent lid assembly. A manifold assembly may be installed within the lavage chamber. The manifold assembly includes a plurality of fluid discharge openings positioned such that when fluid is sent through the fluid discharge openings, the fluid contacts an interior surface of the transparent lid assembly for rinsing the transparent lid assembly.

6 Claims, 4 Drawing Sheets

EXTREMITY ATTACHED CONTAINMENT APPARATUS FOR LAVAGED FLUIDS

BACKGROUND OF THE INVENTION

1. Field of the Invention

The present invention relates generally to devices used in lavage of extremities, and, more particularly, to devices especially adapted for containing waste fluids that result from lavage of extremities.

2. Description of the Prior Art

When any type of orthopedic trauma that has an open wound arrives in surgery, proper protocol is to clean out the wound. The actions of wound cleaning are often referred to as irrigate and debride. To conduct irrigation and debridement, the physician or other medical worker generally uses a system known as Pulsevac which is a shower-like irrigating system which loosens dirt, bloody particles and any foreign materials from the wound. Normal saline solution is often used as the irrigating fluid.

Although the irrigation and debridement are successful in wound cleaning, a large amount of waste fluids are produced. The waste fluids include body fluids and tissues and waste irrigation fluid. A serious problem results from the fluid mess that results from the fluid lavage. The messy fluids often splash in many directions and often end up on the floor. With the dangers of communicable diseases such as AIDS and hepatitis, wearing a mask, safety goggles, and other protective gear does not provide adequate protection to the surgical staff. In this respect, it would be desirable if a device for collecting irrigation and debridement wastes were provided which prevents irrigation fluids from splashing onto medical personnel as the irrigation and debridement is carried out. Also, it would be desirable if a device for collecting irrigation and debridement wastes were provided which prevented the wastes from collecting on the floor.

When an appendage such as an arm or leg is injured, it would be desirable to have a device especially adapted to contain the waste fluids that result from lavage of the injured appendage.

When a dirty wound is lavaged, the dirt and other materials that are washed away are often scattered and diluted. In many cases, however, it would be desirable to collect the washings so that they can be inspected and examined.

In the stressful environment of emergency care, some details as to treatment may be overlooked in the emergency conditions. For example, the physician or other medical worker may want to know the volume of waste lavage fluids collected. In this respect, it would be desirable if a device for collecting irrigation and debridement wastes were provided which enabled measurement of the volume of the collected fluids.

An appendage such as an arm or a leg is generally cylindrically shaped. In this respect, for adequate lavage, all sides of the appendage should be exposed to lavage fluids. To accomplish this result, a containment device for lavage fluids should permit all sides of the appendage to be exposed to the lavage fluids.

A given appendage, whether an arm or a leg, may come in many shapes and sizes. In this respect, it would be desirable if a device for collecting irrigation and debridement wastes were provided which were readily adapted to fit onto a variety of sizes of appendages.

As stated above, irrigation and debridement often takes place during emergency conditions. In this respect, any device for containing waste lavage fluids should be capable of being-installed rapidly and easily.

During the course of lavage, before the lavage is complete, waste fluids are continuously produced. In this respect, a device for containing waste lavage fluids may be temporarily made quite dirty. With this in mind, it would be desirable if a waste fluid containment device were provided with means for temporarily cleaning the waste containment device during an on-going lavage process.

To assure that waste lavage fluids are contained within a containment device, it would be desirable if a water-fight seal were provided between the exterior and the interior of the containment device.

As lavage is carried out and as the containment device continuously receives waste fluids during lavage, it is important that the containment device permits medical personnel to observe the lavage process as the lavage process is carried out and as the waste fluids are contained.

Throughout the years, a number of innovations have been developed relating to collection of bodily fluids that drain from a patient, and the following U.S. patents are representative of some of those innovations: U.S. Pat. Nos. 4,086,925; 4,725,270; 4,974,604; 5,107,857; and 5,171,307.

Of the patents just mentioned, U.S. Pat. No. 4,974,604 discloses a surgical drape for a leg with a fluid collection system. With this device, the materials are all flaccid and provide no structural support for the leg. In this respect, the leg must be bent at the knee so that the calf is substantially vertical when the device is used. Often, however, a leg sustains injuries so that it is not desirable to bend the leg at the knee. In this respect, it would be desirable if a device for collecting irrigation and debridement wastes were provided which provided structural support for an appendage and did not require the appendage to be bent so that a portion of the appendage is in a vertical orientation during lavage.

U.S. Pat. No. 5,171,307 discloses a device for collecting irrigation solution from an eye irrigation. Such a device is not adaptable to an appendage such as an arm or leg.

Thus, while the foregoing body of prior art indicates it to be well known to use devices for collecting waste fluids from a lavage process, the prior art described above does not teach or suggest an extremity attached containment apparatus for lavaged fluids which has the following combination of desirable features: (1) prevents irrigation fluids from splashing onto medical personnel as the irrigation and debridement is carried out; (2) prevents the wastes from collecting on the floor; (3) is especially adapted to contain the waste fluids that result from lavage of an injured appendage; (4) collects the lavage washings so that they can be inspected and examined; (5) enables measurement of the volume of the collected fluids; (6) permits all sides of the appendage to be exposed to the lavage fluids; (7) adapts to fit onto a variety of sizes of appendages; (8) is capable of being installed rapidly and easily; (9) includes means for temporarily cleaning the waste containment device during an on-going lavage process; (10) provides a water-tight seal between the exterior and the interior of the containment device; (11) permits medical personnel to observe the lavage process as the lavage process is carried out and as the waste fluids are contained; and (12) provides structural support for an appendage and does not require the appendage to be bent so that a portion of the appendage is in a vertical orientation during lavage. The foregoing desired characteristics are provided by the unique extremity attached containment apparatus for lavaged fluids of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved containment apparatus for lavaged fluids which includes a container assembly and a transparent lid assembly placed on top of the container assembly with a patient's appendage contained therebetween. The container assembly includes a first end and a second end respectively adapted to support and partially encompass an appendage of a patient. The first end and the second end include respective first sealing assemblies for preventing fluids from leaking past the patient's appendage and the respective first end and the second end of the container assembly. The container assembly includes a first side and a second side separated from each other by the first end and the second end.

A transparent lid assembly is adapted to be supported by the first side and the second side of the container assembly. The transparent lid assembly and the container assembly define a lavage chamber. The transparent lid assembly includes a first side adapted to be supported by the first side of the container assembly and includes a second side adapted to be supported by the second side of the container assembly. The transparent lid assembly also includes a first end and a second end respectively adapted to partially encompass the patient's appendage. The first end and the second end include respective second sealing assemblies for preventing fluids from leaking past the patient's appendage and the respective first end and the second end of the transparent lid assembly.

The transparent lid assembly includes a plurality of entry ports for permitting a lavage nozzle to pass through the transparent lid assembly into the lavage chamber wherein edges of the first sealing assemblies are placed in registration with corresponding edges of the second sealing assemblies to form water-tight seals between the patient's appendage and the respective first sealing assemblies and second sealing assemblies.

The entry ports include flap valves for sealing the entry ports when a lavage nozzle is not inserted therethrough. The container assembly includes a sloped floor which directs fluids toward a drain pipe. The drain pipe is positioned above the sloped floor so as to prevent solid materials from draining out of the drain pipe.

The first end, the second end, the first side, and the second side of the container assembly include respective upper edge portions which include respective first sealing members which engage complementary respective second sealing members located at respective lower edges of the first end, the second end, the first side, and the second side of the transparent lid assembly, respectively. The first sealing members are in the form of a U-shaped track, and the second sealing members are in the form of a resilient lip that fits into the U-shaped track with a resilient, substantially water-tight seal.

An inflatable sealing assembly may be provided for sealing the patient's appendage with respect to the container assembly and the transparent lid assembly. The inflatable sealing assembly includes an inflatable ring supported by the container assembly, an inflation tube for supplying air to the inflatable ring, and a squeeze bulb for providing air through the inflation tube to the inflatable ring.

A manifold assembly may be installed within the lavage chamber. The manifold assembly includes a plurality of fluid discharge openings positioned such that when fluid is sent through the fluid discharge openings, the fluid contacts an interior surface of the transparent lid assembly for rinsing the transparent lid assembly. The manifold assembly includes an input pipe for connection to a supply of fluid. A valve assembly for controlling flow of fluid from the fluid supply to the lavage chamber. A trunk pipe is connected to the valve assembly. A plurality of branch pipes is connected to the trunk pipe, wherein each of the branch pipes includes a respective fluid discharge opening.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved extremity attached containment apparatus for lavaged fluids which has all of the advantages of the prior art and none of the disadvantages.

It is another object of the present invention to provide a new and improved extremity attached containment apparatus for lavaged fluids which may be easily and efficiently manufactured and marketed.

It is a further object of the present invention to provide a new and improved extremity attached containment apparatus for lavaged fluids which is of durable and reliable construction.

An even further object of the present invention is to provide a new and improved extremity attached containment apparatus for lavaged fluids which is susceptible of a low cost of manufacture with regard to both materials and labor, and which accordingly is then susceptible of low prices of sale to the consuming public, thereby making such extremity attached containment apparatus for lavaged fluids available to the buying public.

Still yet a further object of the present invention is to provide a new and improved extremity attached containment apparatus for lavaged fluids which prevents irrigation fluids from splashing onto medical personnel as the irrigation and debridement is carried out.

Still another object of the present invention is to provide a new and improved extremity attached containment apparatus for lavaged fluids that prevents the wastes from collecting on the floor.

Yet another object of the present invention is to provide a new and improved extremity attached containment apparatus for lavaged fluids which is especially adapted to contain the waste fluids that result from lavage of an injured appendage.

Even another object of the present invention is to provide a new and improved extremity attached containment apparatus for lavaged fluids that collects the lavage washings so that they can be inspected and examined.

Still a further object of the present invention is to provide a new and improved extremity attached containment apparatus for lavaged fluids which enables measurement of the volume of the collected fluids.

Yet another object of the present invention is to provide a new and improved extremity attached containment apparatus for lavaged fluids that permits all sides of the appendage to be exposed to the lavage fluids.

Still another object of the present invention is to provide a new and improved extremity attached containment apparatus for lavaged fluids which adapts to fit onto a variety of sizes of appendages.

Yet an even further object of the present invention is to provide a new and improved extremity attached containment apparatus for lavaged fluids that is capable of being installed rapidly and easily.

Still a further object of the present invention is to provide a new and improved extremity attached containment apparatus for lavaged fluids that includes means for temporarily cleaning the waste containment device during an on-going lavage process.

Yet another object of the present invention is to provide a new and improved extremity attached containment apparatus for lavaged fluids which provides a water-tight seal between 'the exterior and the interior of the containment device.

Still a further object of the present invention is to provide a new and improved extremity attached containment apparatus for lavaged fluids that permits medical personnel to observe the lavage process as the lavage process is carried out and as the waste fluids are contained.

Yet another object of the present invention is to provide a new and improved extremity attached containment apparatus for lavaged fluids which provides structural support for an appendage and does not require the appendage to be bent so that a portion of the appendage is in a vertical orientation during lavage.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
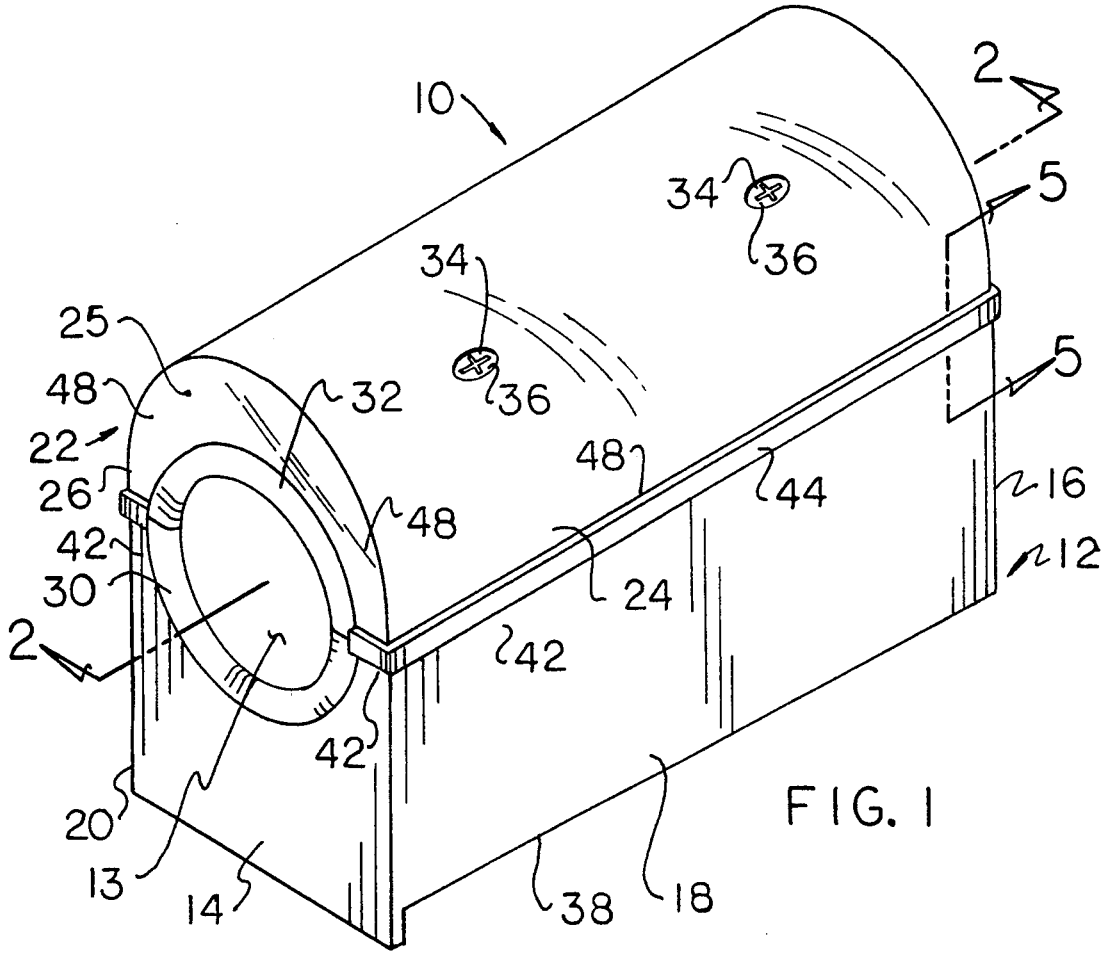
FIG. 1 is a perspective view showing a first preferred embodiment of the extremity attached containment apparatus for lavaged fluids of the invention.
Figure 2:
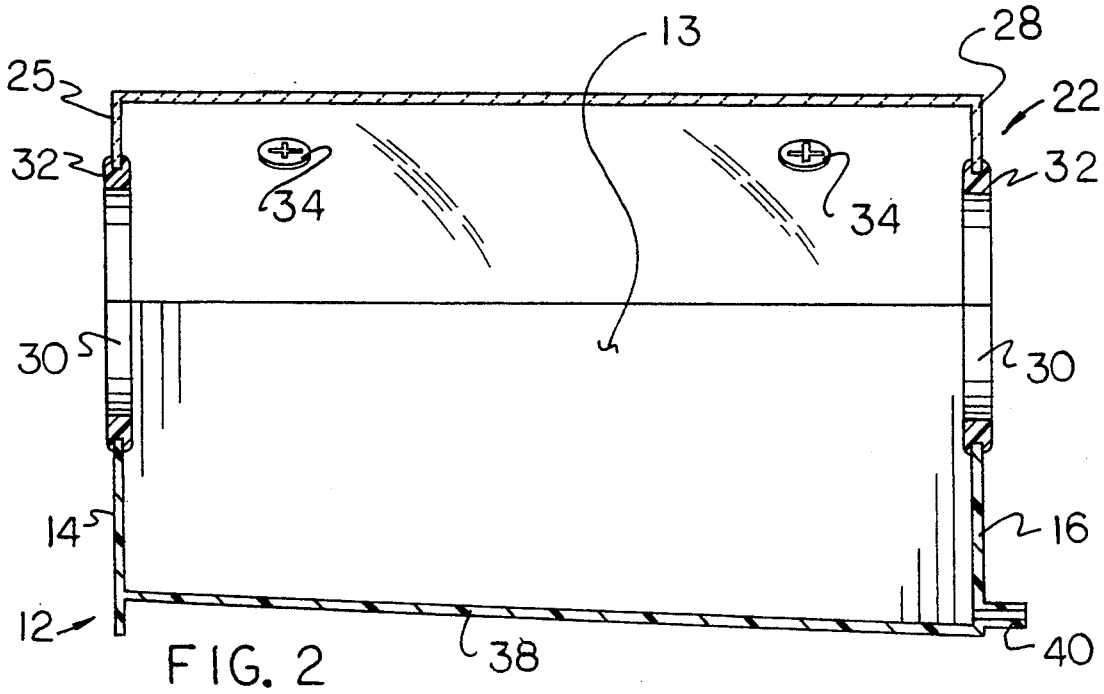
FIG. 2 is a cross-sectional view of the embodiment shown in FIG. 1 taken along line 2—2 of FIG. 1.
Figure 4:
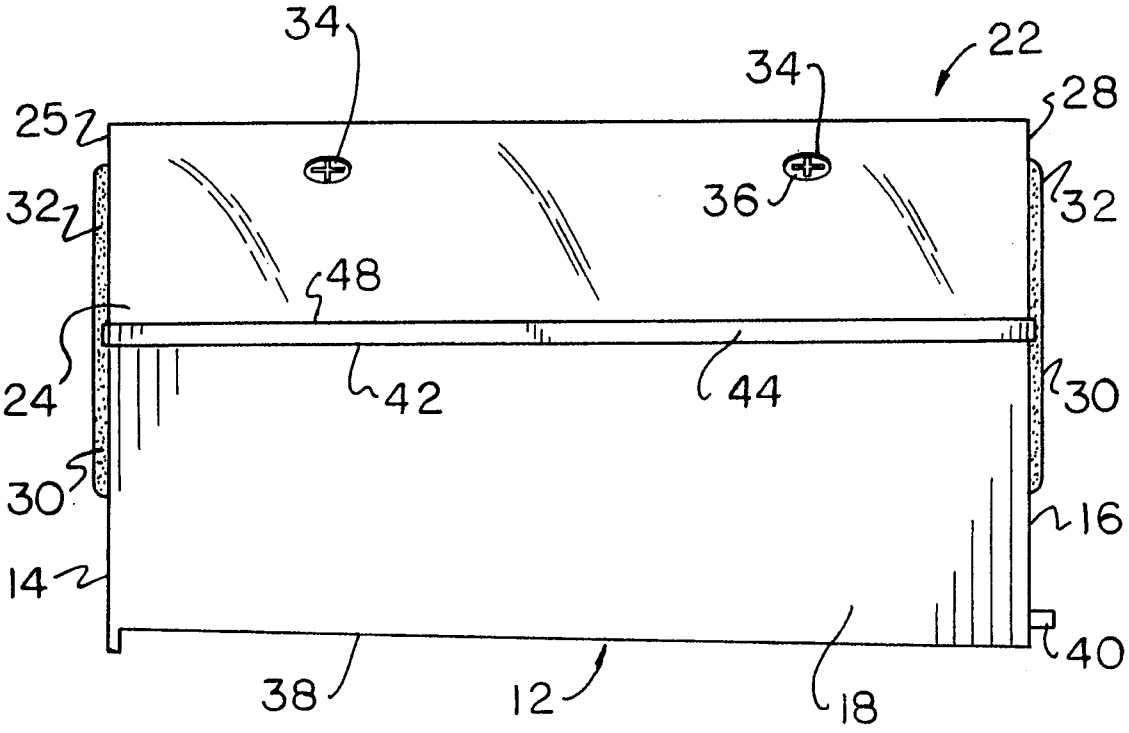
FIG. 4 is a side view of the embodiment of the invention shown in FIG. 1.
Figure 3:
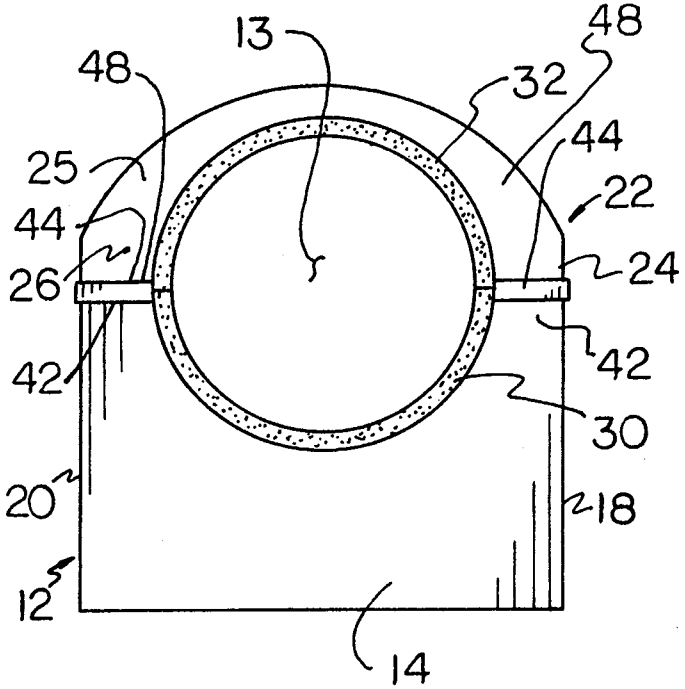
FIG. 3 is a front view of the embodiment shown in FIG. 1.

With reference to the drawings, a new and improved extremity attached containment apparatus for lavaged fluids embodying the principles and concepts of the present invention will be described.

Turning initially to FIGS. 1–5, there is shown a first exemplary embodiment of the extremity attached containment apparatus for lavaged fluids of the invention generally designated by reference numeral 10. In its preferred form, extremity attached containment apparatus for lavaged fluids 10 includes a container assembly 12 and a transparent lid assembly 22 placed on top of the container assembly 12 with a patient's appendage contained therebetween. The container assembly 12 includes a first end 14 and a second end 16 respectively adapted to support and partially encompass an appendage of a patient. The first end 14 and the second end 16 include respective first sealing assemblies 30 for preventing fluids from leaking past the patient's appendage and the respective first end 14 and the second end 16 of the container assembly 12. The container assembly 12 includes a first side 18 and a second side 20 separated from each other by the first end 14 and the second end 16.

A transparent lid assembly 22 is adapted to be supported by the first side 18 and the second side 20 of the container assembly 12. The transparent lid assembly 22 and the container assembly 12 define a lavage chamber 13. The transparent lid assembly 22 includes a first side 24 adapted to be supported by the first side 18 of the container assembly 12 and includes a second side 26 adapted to be supported by the second side 20 of the container assembly 12. The transparent lid assembly 22 also includes a first end 25 and a second end 28 respectively adapted to partially encompass the patient's appendage. The first end 25 and the second end 28 include respective second sealing assemblies 32 for preventing fluids from leaking past the patient's appendage and the respective first end 25 and the second end 28 of the transparent lid assembly 22.

The transparent lid assembly 22 includes a plurality of entry ports 34 for permitting a lavage nozzle (not shown) to pass through the transparent lid assembly 22 into the lavage chamber 13. The first sealing assemblies 30 and the second sealing assemblies 32 can be made from a sponge rubber material. wherein edges of the first sealing assemblies 30 are placed in registration with corresponding edges of the second sealing assemblies 32 to form water-tight seals between the patient's appendage and the respective first sealing assemblies 30 and second sealing assemblies 32.

The entry ports 34 include flap valves 36 for sealing the entry ports 34 when a lavage nozzle is not inserted therethrough. The container assembly 12 includes a sloped floor 38 which directs fluids toward a drain pipe 40. The drain pipe 40 is positioned above the sloped floor 38 so as to prevent solid materials from draining out of the drain pipe 40.

The first end 14, the second end 16, the first side 18, and the second side 20 of the container assembly 12 include respective upper edge portions 42 which includes respective first sealing members 44 which engage complementary respective second sealing members 46 located at respective lower edges 48 of the first end 25, the second end 28, the first side 24, and the second side 26 of the transparent lid assembly 22, respectively. The first sealing members 44 are in the form of a U-shaped track, and the second sealing members 46 are in the form of a resilient lip that fits into the U-shaped track with a resilient, substantially water-tight seal.

In use, the container assembly 12 is placed in a suitable location on a suitable support, such as a table; and the patients appendage, e.g. leg or arm, is supported by the two first sealing assemblies 30 on the first end 14 and the second end 16 of the container assembly 12. The first sealing assemblies 30 are semi-circular and partially encompass the appendage. The transparent lid assembly 22 is then placed on the container assembly 12. More specifically the second sealing members 46 of the transparent lid assembly 22 are engaged with the first sealing members 44 of the container assembly 12 to provide a water-tight seal. Moreover, the second sealing assemblies 32 on the transparent lid assembly 22 partially encompass the appendage. The second sealing assemblies 32 are semi-circular and complement the semi-circular first sealing assemblies 30. When the transparent lid assembly 22 is placed on the container assembly 12, the appendage is fully encompassed and sealed by the first sealing assemblies 30 and the second sealing assemblies 32 at the first end 14 and the second end 16 of the container assembly 12.

Then, a hand-held nozzle (not shown), which is attached to a pressurized source of lavage fluid (not shown), is inserted into one of the entry ports 34. The lavage fluid is turned on. To change position of the lavage nozzle, the source of flow is turned off, the nozzle is removed from the first entry port 34, and the nozzle is placed in another entry port 34 at a different position. When the lavage nozzle is removed from a specific entry port 34, the flap valves 36 automatically close to seal the unused entry port 34.

The drain pipe 40 can be connected to a calibrated container so that the quantity of waste fluids collected can be measured. The drain pipe 40 can be connected to a suction pump. The drain pipe 40 can be adapted to a variety of suction pumps. If desired, the extremity attached containment apparatus for lavaged fluids of the invention can be made in two general sizes, one for the arm and the other for the leg. The container assembly 12 for the upper extremity can measure 15 inches by 24 inches. The container assembly 12 for the lower extremity can measure 18 inches by 36 inches.

Figure 6:
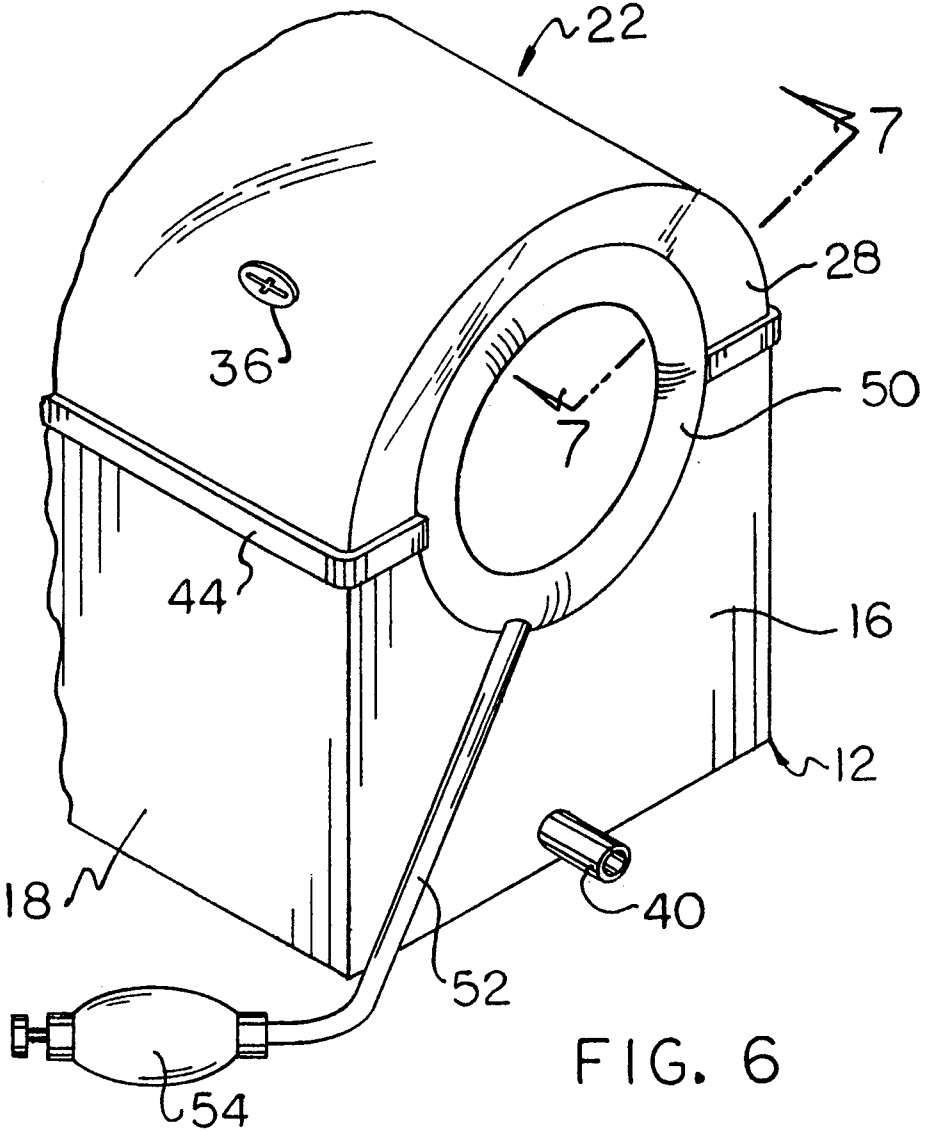
FIG. 6 is a partial perspective view of a second embodiment of the extremity attached containment apparatus for lavaged fluids of the invention which includes an inflatable seal.
Figure 5:
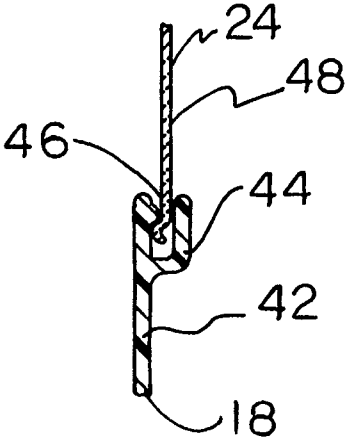
FIG. 5 is a partial cross-sectional view of the embodiment the invention shown in FIG. 1 taken along line 5—5 of FIG. 1.
Figure 7:
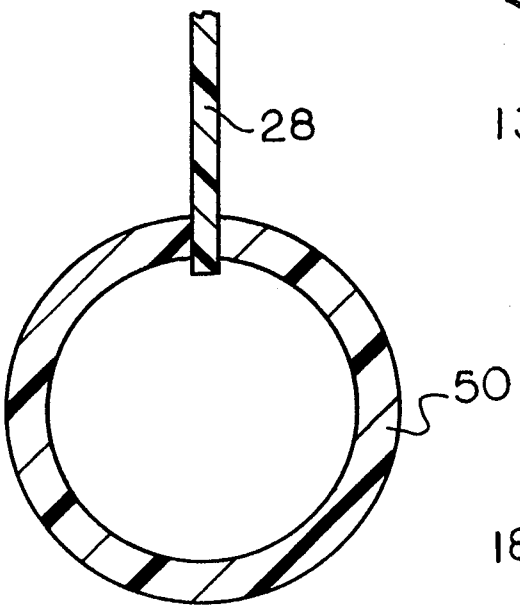
FIG. 7 is a partial cross-sectional view of the embodiment of the invention shown in FIG. 6 taken along line 7—7 thereof.

Turning to FIGS. 6–7, a second embodiment of the invention is shown. Reference numerals are shown that correspond to like reference numerals that designate like elements shown in the other figures. In addition, an inflatable sealing assembly is provided for sealing the patient's appendage with respect to the container assembly 12 and the transparent lid assembly 22. In essence, the first sealing assemblies 30 and the second sealing assemblies 32 are integrated into a unified sealing structure.

The inflatable sealing assembly includes an inflatable ring 50 supported by the container assembly 12, an inflation tube 52 for supplying air to the inflatable ring 50, and a squeeze bulb 54 for providing air through the inflation tube 52 to the inflatable ring 50.

Figure 8:
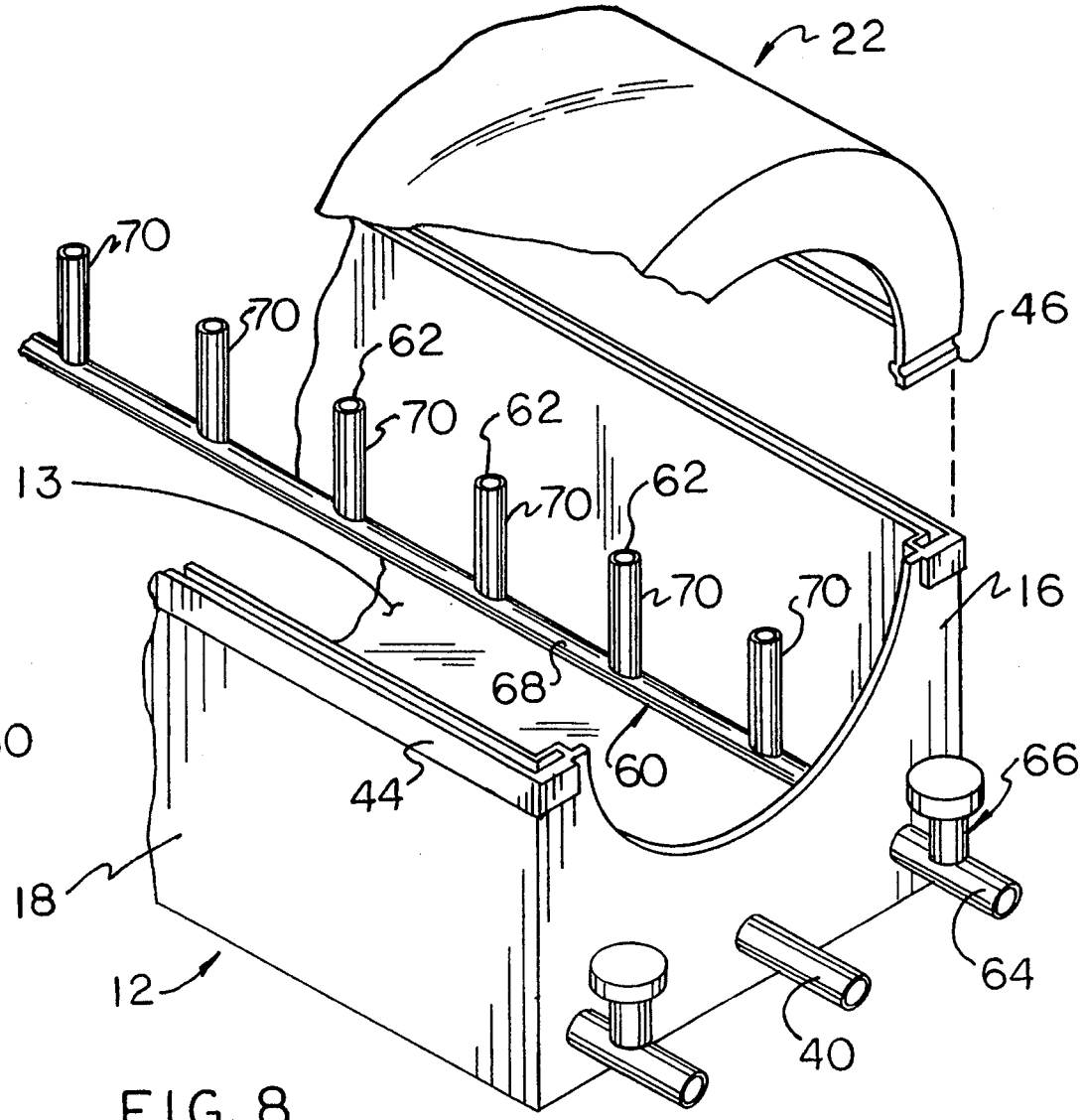
FIG. 8 is a partially exploded, partial perspective view of a third embodiment of the extremity attached containment apparatus for lavaged fluids of the invention which includes a manifold for washing the interior surface of the top portion of the apparatus.

Turning to FIG. 8, a third embodiment of the invention is shown. Reference numerals are shown that correspond to like reference numerals that designate like elements shown in the other figures. In addition, a manifold assembly 60 is installed within the lavage chamber 13. The manifold assembly 60 includes a plurality of fluid discharge openings 62 positioned such that when fluid is sent through the fluid discharge openings 62, the fluid contacts an interior surface of the transparent lid assembly 22 for rinsing the transparent lid assembly 22.

The manifold assembly 60 includes an input pipe 64 for connection to a supply of fluid. A valve assembly 66 for controlling flow of fluid from the fluid supply to the lavage chamber 13. A trunk pipe 68 is connected to the valve assembly 66. A plurality of branch pipes 70 is connected to the trunk pipe 68, wherein each of the branch pipes 70 includes a respective fluid discharge opening 62.

In use, when the valve assembly 66 is turned on, fluid flows from the fluid supply (not shown), to the trunk pipe 68, to the branch pipes 70, and through the fluid discharge openings 62 onto the interior surface of the transparent lid assembly 22 for rinsing it.

The components of the extremity attached containment apparatus for lavaged fluids of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved extremity attached containment apparatus for lavaged fluids that is low in cost, relatively simple in design and operation, and which may advantageously be used to prevent irrigation fluids from splashing onto medical personnel as the irrigation and debridement is carried out. With the invention, an extremity attached containment apparatus for lavaged fluids is provided which prevents the wastes from collecting on the floor. With the invention, an extremity attached containment apparatus for lavaged fluids is provided which is especially adapted to contain the waste fluids that result from lavage of an injured appendage. With the invention, an extremity attached containment apparatus for lavaged fluids is provided which collects the lavage washings so that they can be inspected and examined. With the invention, an extremity attached containment apparatus for lavaged fluids is provided which enables measurement of the volume of the collected fluids. With the invention, an extremity attached containment apparatus for lavaged fluids is provided which permits all sides of the appendage to be exposed to the lavage fluids. With the invention, an extremity attached containment apparatus for lavaged fluids is provided which adapts to fit onto a variety of sizes of appendages. With the invention, an extremity attached containment apparatus for lavaged fluids is provided which is capable of being installed rapidly and easily. With the invention, an extremity attached containment apparatus for lavaged fluids is provided which includes means for temporarily cleaning the waste containment device during an on-going lavage process. With the invention, an extremity attached containment apparatus for lavaged fluids is provided which provides a water-tight seal between the exterior and the interior of the containment device. With the invention, an extremity attached containment apparatus for lavaged fluids is provided which permits medical personnel to observe the lavage process as the lavage process is carried out and as the waste fluids are contained. With the invention, an extremity attached containment apparatus for lavaged fluids is provided which provides structural support for an appendage and does not require the appendage to be bent so that a portion of the appendage is in a vertical orientation during lavage.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A containment apparatus for layaged fluids, comprising:

an elongate container assembly which includes a first end and a second end respectively positioned along a longitudinal axis and adapted to support and partially encompass an appendage of a patient, said first end and said second end including respective first sealing assemblies for preventing fluids from leaking past the patient's appendage and said respective first end and said second end of said container assembly, said container assembly including a first side and a second side separated from each other by said first end and said second end, and an elongate transparent lid assembly adapted to be supported by said first side and said second side of said container assembly, said transparent lid assembly and said container assembly defining a lavage chamber, said transparent lid assembly including a first side adapted to be supported by said first side of said container assembly and including a second side adapted to be supported by said second side of said container assembly, said transparent lid assembly also including a first end and a second end positioned along said longitudinal axis and respectively adapted to partially encompass the patient's appendage, said first end and said second end including respective second sealing assemblies for preventing fluids from leaking past the patient's appendage and said respective first end and said second end of said transparent lid assembly, said transparent lid assembly including a plurality of valved entry ports for permitting a lavage nozzle to pass through said transparent lid assembly into said lavage chamber, wherein edges of said first sealing assembly are placed in registration with corresponding edges of said second sealing assemblies to form a water-tight seal between the patient's appendage and said respective first sealing assemblies and second sealing assemblies.

2. The apparatus described in claim 1 wherein said entry ports include flap valves for sealing said entry ports when a lavage nozzle is not inserted therethrough.

3. The apparatus described in claim 1 wherein said container assembly includes a sloped floor which directs fluids toward a drain pipe.

4. The apparatus described in claim 3 wherein said drain pipe is positioned above said sloped floor so as to prevent solid materials from draining out of said drain pipe.

5. The apparatus described in claim 1 wherein said first end, said second end, said first side, and said second side of said container assembly include respective upper edge portions which include respective first sealing members which engage complementary respective second sealing members located at respective lower edges of said first end, said second end, said first side, and said second side of said transparent lid assembly, respectively.

6. The apparatus described in claim 1 wherein:

said first sealing members are in the form of a U-shaped track, and said second sealing members are in the form of a resilient lip that fits into said U-shaped track with a resilient, substantially water-tight seal.

* * * * *